United States Patent [19]

Hoffman

[11] Patent Number: 4,501,354

[45] Date of Patent: Feb. 26, 1985

[54] SOAP SAVING DEVICE

[76] Inventor: Edward C. Hoffman, 4 Kane Ct., Clarendon Hills, Ill. 60514

[21] Appl. No.: 613,580

[22] Filed: May 24, 1984

[51] Int. Cl.[3] ..... A47K 5/08; B65D 85/62; B29C 3/00; B29C 27/00

[52] U.S. Cl. ..... 206/77.1; 206/499; 425/84; 425/318; 425/412; 24/16 PB

[58] Field of Search ..... 206/77.1, 499; 100/219, 100/212; 24/16 PB; 425/84, 318, 412

[56] References Cited

U.S. PATENT DOCUMENTS

| | | | |
|---|---|---|---|
| 1,936,395 | 11/1933 | Ingram | 206/499 |
| 3,148,430 | 9/1964 | Hanner | 425/318 |
| 3,339,246 | 9/1967 | Geisinger | 24/16 PB |
| 3,532,063 | 10/1970 | Withers | 206/499 |
| 4,035,122 | 7/1977 | Cavanaugh | 425/318 |
| 4,135,272 | 1/1979 | Stephenson | 24/16 PB |
| 4,344,529 | 8/1982 | Ibarzabal | 206/77.1 |

*Primary Examiner*—William T. Dixson, Jr.
*Attorney, Agent, or Firm*—A. G. Douvas

[57] ABSTRACT

A soap saving device for pressure bonding two or more pieces of soap, comprising a one-piece structure which is an elongated, thin, flexible plastic strap. The strap includes a central section which serves as a supporting base for the pieces of soap which are to be bonded together, and a locking handle section extending from each side of the supporting base. When the handle sections are locked together so as to envelop two or more pieces of soap placed on the supporting base, the force exerted on the soap pieces by the tensioned strap pressure bonds these pieces into a usable bar. In a modification, a plastic soap retaining dish having a hinged clamping tab is substituted for one of the locking handle sections.

11 Claims, 13 Drawing Figures

SOAP SAVING DEVICE

The present invention relates to apparatus for conserving soap, and in particular to apparatus for pressure bonding two or more pieces of soap.

A bar of soap is rarely fully used. The thin slivers remaining after extensive use of a soap bar become dried out and break into small unwieldy pieces which are usually thrown away.

As the price of soap increases with inflation, it becomes desirable for those on limited budgets to find an effective way of saving and using soap remnants.

Devices for pressure bonding two pieces of soap are disclosed in the prior art. U.S. Pat. Nos. 4,344,529, 2,975,485, 2,485,347, and 339,376 disclose typical prior art structures. All of these devices employ a plurality of mechanical elements, which while effective to bond pieces of soap, are difficult to clean because of the multiplicity of components. Additionally, the cost to manufacture the individual components and to assemble them into a working combination has prevented their extensive use.

Accordingly, a principal object of this invention is to provide improved apparatus for pressure bonding pieces of soap. This apparatus is characterized by a simple design that is easy to operate and clean, and also inexpensive to manufacture.

A principal embodiment of the invention comprises a one-piece structure which is an elongated, thin, flexible plastic strap. The strap comprises basically a central section which serves as a supporting base for the pieces of soap which are to be bonded together and a locking handle section extending from each side of the supporting base. When the handle sections are locked together so as to envelop two or more pieces of soap placed on the supporting base, the force exerted on the soap pieces by the tensioned strap pressure bonds these pieces into a single usable larger piece or bar of soap.

A second preferred embodiment substitutes a plastic soap retaining dish for one of the locking handle sections. The other locking handle section is integrally molded to one end of the soap dish so that it may be locked under tension to the far side of the soap dish. Two or more pieces of soap located in the dish are pressure bonded by the force exerted by the tensioned strap.

DESCRIPTION OF THE DRAWINGS

In order that all of the structural features for attaining the objects of this invention may be readily understood, detailed reference is made to the accompanying drawings wherein.

DESCRIPTION OF THE PREFERRED EMBODIMENTS

Figure 1:
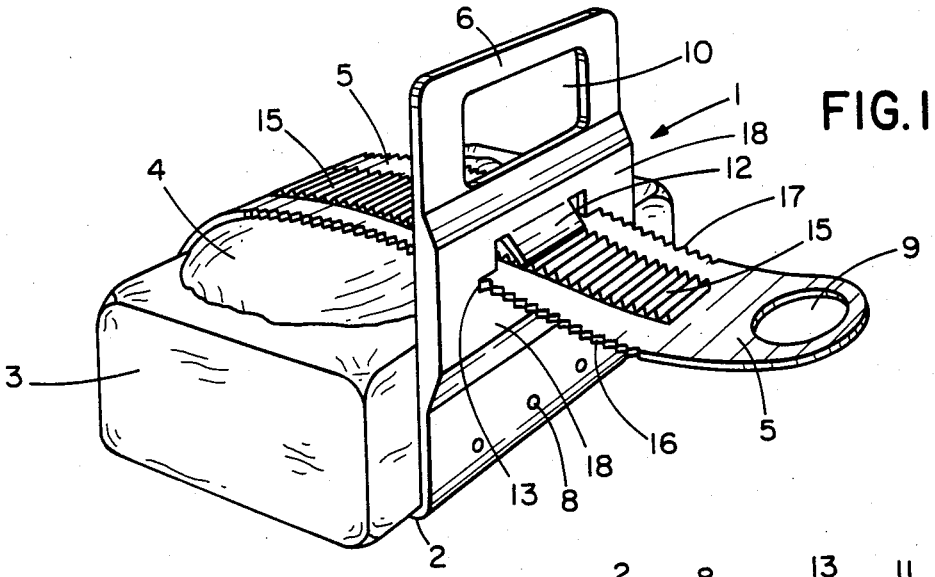
FIG. 1 is a perspective view of a first preferred embodiment of the soap saving strap of this invention shown pressure bonding a soap sliver to a bar of soap.
Figure 2:
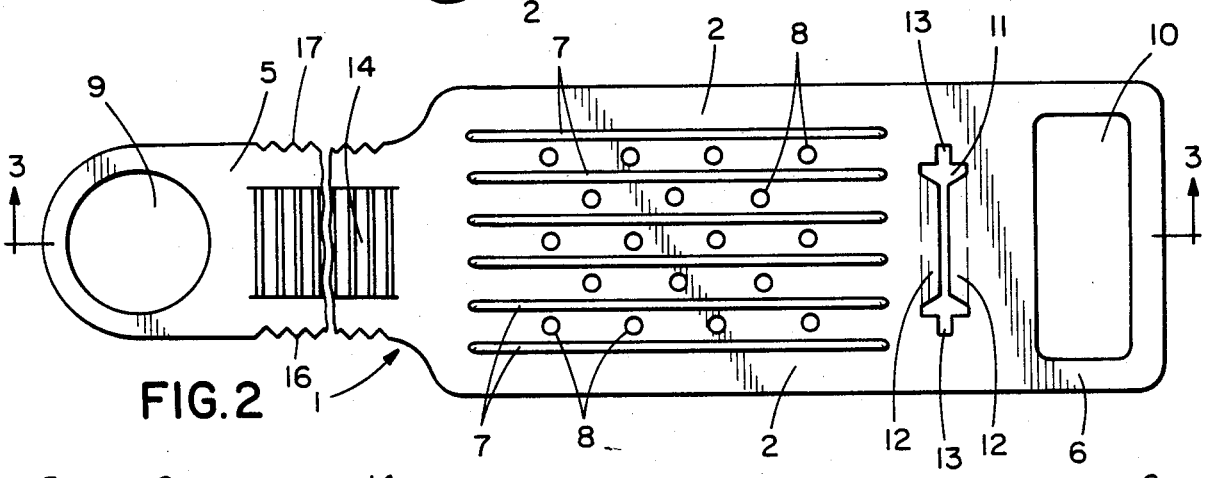
FIG. 2 is a plan view of the soap saving strap of FIG. 1.
Figure 3:
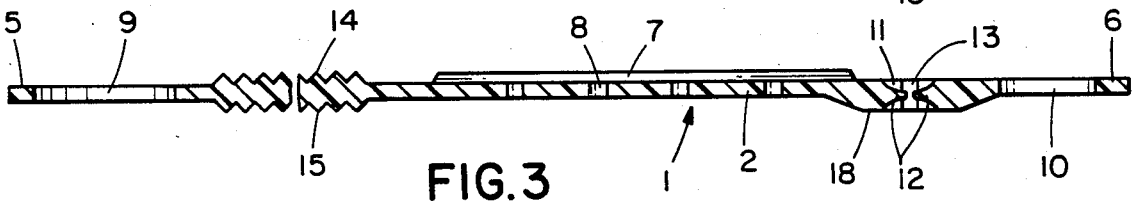
FIG. 3 is a cross-section view of the strap taken along line 3—3 of FIG. 2.

A first preferred embodiment of the soap saving device of this invention is shown in FIGS. 1–3 of the drawings. This embodiment features an elongated, thin, flexible strap 1 which includes a generally rectangular central section which serves as a support base 2 for soap bar 3 and sliver 4. Soap bar 3 and soap sliver 4 are pressure bonded together when soap pieces 3, 4 are tightly enveloped (FIG. 1) by placing strap 1 under tension in response to the locking of handle sections 5 and 6 to one another.

Handle sections 5 and 6 are integrally joined to opposite sides of supporting base 2 so that strap 1 comprises a unitary elongated flexible strap. Strap 1 is preferably fabricated of plastic, although materials such as canvas, leather and rubber could be employed. When plastic is employed, strap 1 is preferably molded or formed with a set of spaced, parallel ridges 7 formed on the surface of supporting base 2 upon which soap bar 3 rests. Ridges 7 prevent soap bar 3 from slipping away from strap 1, and they also assist in drying any wet soap bar.

Other design configurations may be substituted for parallel ridges 7. For example, a "waffle" pattern of ridges could be employed to prevent soap bar 3 from slipping in any direction.

A pattern of small holes 8 is interspersed between ridges 7 to facilitate water drainage from a wet bar of soap.

Handle section 5 is formed with a circular finger hole 9, and handle section 6 is preferably formed with an elongated finger slot 10. Hole 9 and finger slot 10 are manually engaged to aid in pulling strap 1 into a tensioned condition which pressure bonds soap bar 3 and soap sliver 4.

Handle section 6 is also formed with a locking slot 11 into which handle section 5 is manually inserted in order to effect tensioning of strap 1 by locking handle sections 5 and 6 together.

Locking slot 11 is formed with an irregular periphery so that a pair of opposing flexible locking tabs 12 project into slot 11. Additionally, each of the two opposing narrow sides of slot 11 are elongated by a pair of locking recesses 13.

As is best shown in FIG. 3, two series of closely spaced locking ridges 14, 15 are molded into the upper and lower surfaces of handle section 5. Closely spaced molded grooves could be substituted for ridges 14, 15, however. Additionally, both edges of handle section 5 adjacent locking ridges 14, 15 are formed with two series of locking teeth 16, 17.

When locking handle section 5 is inserted into locking slot 11 and locking teeth 16, 17 are engaged in recesses 13, flexible tabs 12 form a lock with ridges 14, 15, and teeth 16, 17 form a lock with the bottom edges of recesses 13 (FIG. 1). Appropriate manual locking adjustment of handle sections 5, 6 relative one another places flexible strap 1 under sufficient tension so strap enveloped soap bar 3 and soap sliver 4 will be pressure bonded one to the other. Both soap bar 3 and soap sliver 4 are preferably in a moderately wet condition in order to facilitate the bonding process. Any excess water will drain in part through drainage holes 8.

Locking handle 6 is preferably formed with a thick reinforced section 18 immediately adjacent slot 11 in order to produce the rigidity necessary to effect a secure lock.

Figure 4:
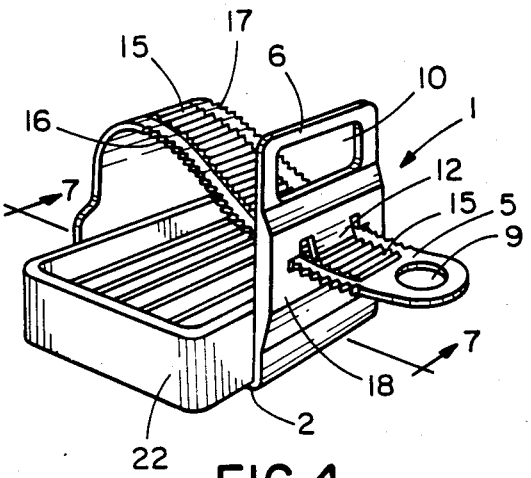
FIG. 4 is a perspective view showing the strap of FIGS. 1–3 engaging a typical conventional soap dish.

In FIG. 4 flexible strap 1 is used with a conventional soap dish 22. If it is desired to pressure bond soap bar 3 and soap sliver 4 while carried in a soap dish, soap dish 22 is placed upon support base 2 of flexible strap 1. Any soap bar and soap sliver combination carried by dish 22 and encircled by strap 1 will be pressure bonded when strap 1 is suitably tensioned.

Figure 5:
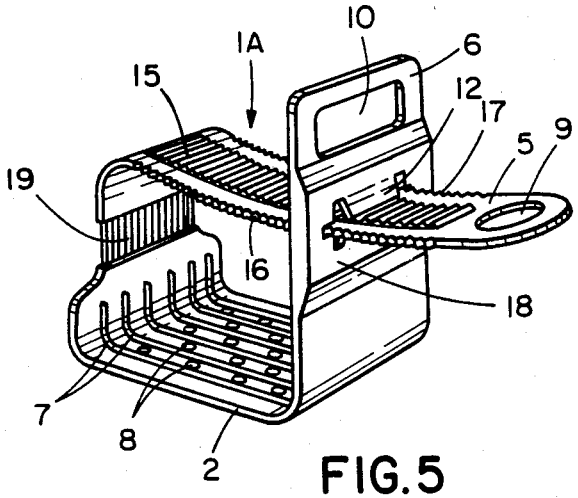
FIG. 5 is a perspective view showing a modification in the basic strap of FIGS. 1—3 in which an elastic insert is incorporated into the strap to increase the pressure bonding force.

A first optional modification 1A of flexible strap 1 is shown in FIG. 5. In this embodiment, an elastic section 19 is cemented, or otherwise inserted as a link into locking handle section 5. The elasticity of section 19 serves to insure that soap bar 3 and soap sliver 4 are maintained under adequate tension to effect pressure bonding.

Figure 6:
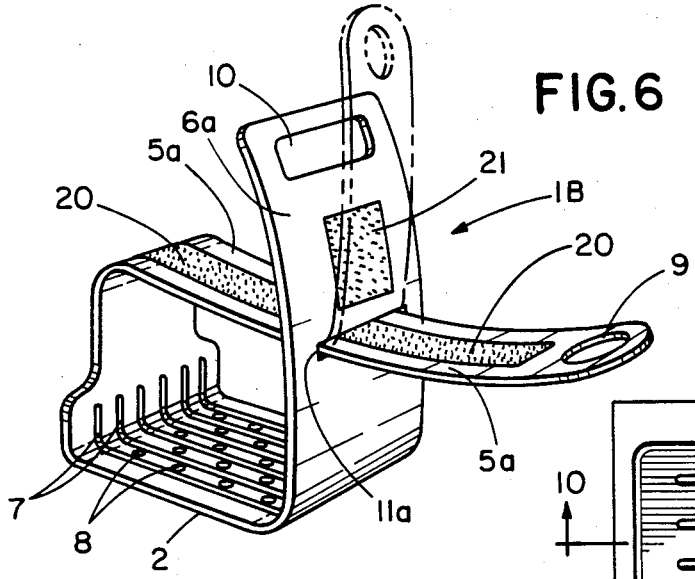
FIG. 6 is a perspective view showing a second modification in the basic strap of FIGS. 1–3 in which a Velcro fastener is substituted for the rack and latch catch of FIGS. 1–3.

A second modification 1B of flexible strap 1 is shown in FIG. 6. In this embodiment, a first strip of Velcro 20 is secured to one surface of modified locking handle **5*a*, and a second strip of Velcro 21 is secured to one surface of modified locking handle 6*a*. Locking handle 6*a* is formed with a modified locking slot 11*a*. Locking slot 11*a* is defined by a rectangular periphery which omits locking tabs 12 and recesses 13 (FIG. 2**).

When locking handle section **5*a* is inserted into slot 11*a* and the projecting handle portion is flexed upwardly (FIG. 6), the two Velcro strips contact one another and form the conventional Velcro lock. It should be noted that in the embodiment of FIG. 6, handle section 5*a* is formed without ridges 14, 15 and teeth 16, 17 of the embodiment of FIG. 1, and handle section 6*a* is formed without reinforced section 18. The Velcro lock of FIG. 6** thus results in a simplified construction.

Figure 8:
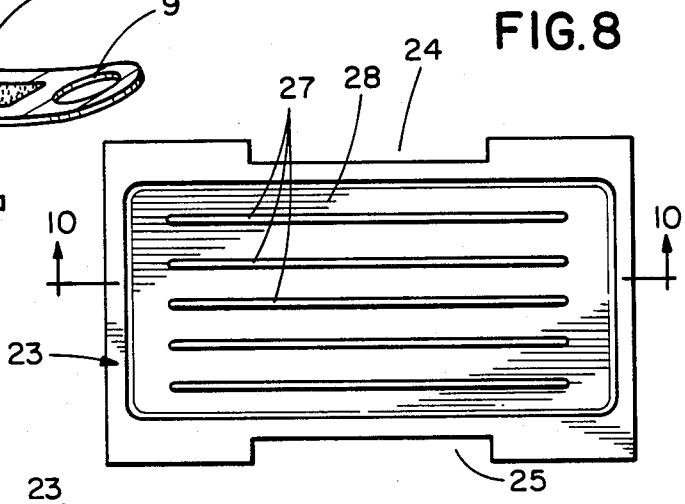
FIG. 8 is a plan view of a custom designed soap dish particularly adapted for the strap of this invention.
Figure 7:
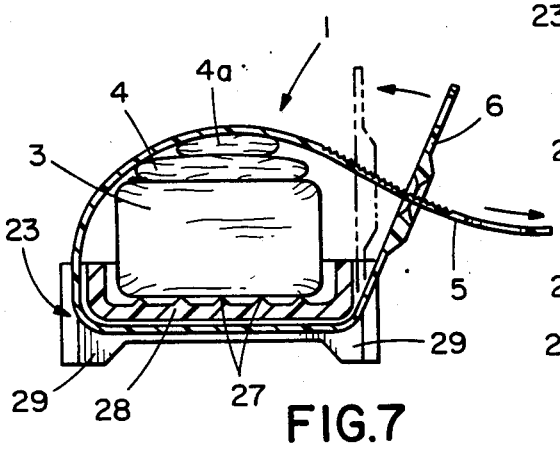
FIG. 7 is a partial cross-section view showing the pressure bonding of a pair of stacked soap slivers to a bar of soap contained within the custom designed soap dish of FIGS. 8–10.
Figure 9:
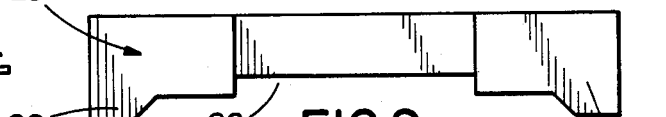
FIG. 9 is a side elevation of the soap dish of FIG. 8.
Figure 10:
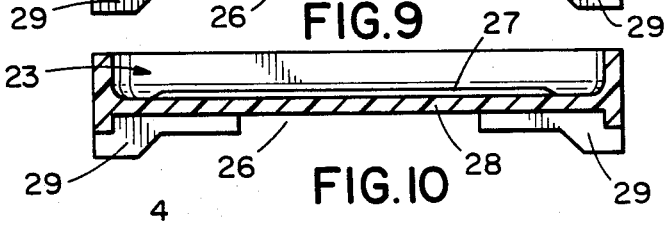
FIG. 10 is a section view taken along line 10—10 of FIG. 8.

In FIG. 7 flexible strap 1 is used with a custom soap dish (FIGS. 8–10). Custom soap dish 23 is formed with a pair of side recesses 24 and 25, joined by bottom recess 26 to form a continuous recess with rounded corners. The recesses are sized to receive strap 1 in the enveloping manner shown in FIG. 7. Soap dish 23 is formed with a set of raised ridges 27 to provide for a flow of circulating air to dry soap bar 3 and soap slivers **4, 4*a* located within the dish (FIG. 7**).

Base 28 of soap dish 23 is supported on a set of elevating legs 29. The continuous recess 24, 25, 26 is accordingly raised above any supporting surface to enable strap 1 to be fed beneath base 28 without manually elevating soap dish 23.

Figure 11:
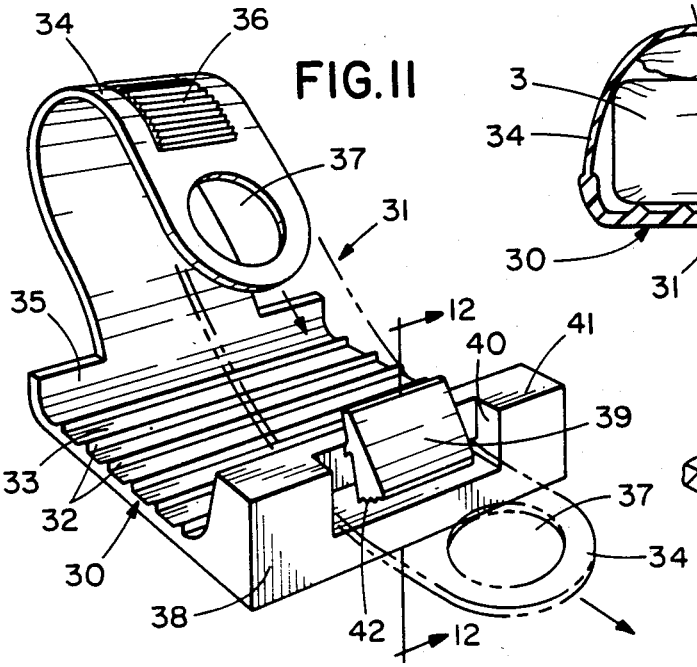
FIG. 11 is a perspective view showing a second basic preferred embodiment of this invention with a soap dish molded as an integral part of the strap.
Figure 12:
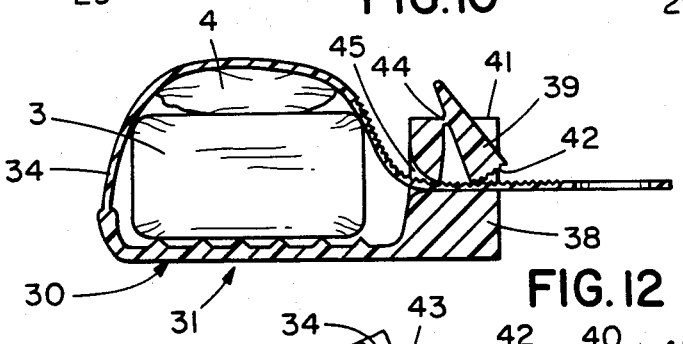
FIG. 12 is a section view of the combined strap and soap dish of FIG. 11 taken along line 11—11 of FIG. 2, showing the pressure bonding of a soap sliver to a bar of soap.
Figure 13:
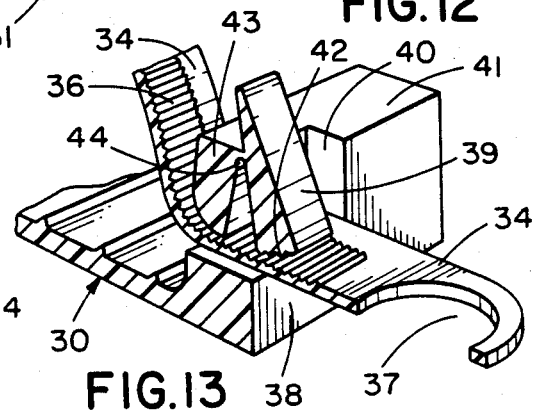
FIG. 13 is a fragmentary perspective view of the hinged clamping tab employed in the embodiment of FIGS. 12 and 13.

A second preferred embodiment of the soap saving device of this invention is shown in FIGS. 11–13 of the drawings. This embodiment features a soap dish 30 molded as an integral part of strap 31. Soap dish 30 is open sided on two sides, and therefore drain holes are not required. A set of spaced ridges 32 extend across support base 33 of soap dish 30 from one open side to the other to facilitate water drainage and also circulation of air.

Flexible strap handle 34 is integrally joined to substantially rigid curved end 35 of soap dish 30. Strap handle 34 is formed with a series of locking ridges 36 located on strap surface only, and also a circular finger hole 37.

Soap dish 30 is formed with a rigid end 38 which serves as a support for hinged wedge-lock tab 39. Soap dish end 38 is molded with a recess 40 centrally located about the upper outside edge 41 of soap dish 30. Wedge-lock tab 39 is preferably generally triangular in cross section with the bottom portion of tab 39 being formed with a series of ridges 42.

Wedge-lock tab 39 is hinged to tab support section 43 at hinge point 44. A strap handle receiving slot 45 is formed in rigid end 38 sufficiently large to permit strap handle 34 to pass therethrough but still pivot tab 39 to the open position shown in FIG. 12. As the manual pulling force is released from handle 34, ridges 36 and 42 engage to pivot tab 39 in a counterclockwise direction about pivot point 44. This pivoting action wedges strap handle 34 into a locked position which maintains strap 31 under sufficient tension to pressure bond soap bar 3 to soap sliver 4.

The above described embodiments are merely illustrative of the principles of this invention. Structural modifications can be made without departing from the scope of the invention.

What is claimed is:

1. A soap saving device for pressure bonding two or more pieces of soap, comprising a base having an irregular surface serving as a support for a first piece of soap placed thereon, a flexible strap handle including first locking means integrally joined to a first side of the base, and second locking means integrally joined to a second side of the base opposite the first side with both locking means being engageable to cause the flexible strap handle to envelop together two or more pieces of soap stacked on the base to exert a pressure bonding force causing the two pieces of soap to bond to one another.

2. The combination of claim 1 in which the base is a soap dish.

3. The combination of claim 1 in which the second locking means includes a second flexible strap handle integrally joined to a second side of the base.

4. The combination of claim 1 in which the irregular surface of the base is formed by a set of spaced ridges.

5. The combination of claim 3 in which the first locking means is a sequence of ridges or depressions integrally formed upon the first strap and the second locking means includes one or more flexible tabs projecting into an elongated slot formed in the second flexible strap with the first strap being insertable into the slot whereby the flexible tab engages the sequence of ridges or depressions to effect a locking engagement of the flexible strap by which the engaged straps are maintained under tension to pressure bond the soap.

6. The combination of claim 3 in which both locking means are adhering strips.

7. The combination of claim 3 in which each flexible strap handle includes a finger engaging opening for manipulating the straps.

8. The combination of claim 4 in which the base includes a pattern of water drainage holes located adjacent the ridges.

9. The combination of claim 5 in which each flexible strap handle includes a finger engaging opening for manipulating the straps.

10. The combination of claim 2 in which the soap dish is open on two opposing ends of the dish, and the strap handle and the second locking means are integrally attached to a different set of opposing ends of the dish.

11. The combination of claim 10 in which the second locking means includes a hinged tab and an adjacent slot integrally formed on the dish end opposite the dish end to which the flexible strap handle is joined, whereby insertion of the flexible strap handle into the slot causes the hinged tab to engage the first locking means.

* * * * *